US005927533A

United States Patent [19]

Payne et al.

[11] Patent Number: 5,927,533

[45] Date of Patent: Jul. 27, 1999

[54] PRESSURED THERMOPLASTIC BEVERAGE CONTAINING BOTTLE WITH FINGER GRIPPING FORMATIONS

[75] Inventors: Michael Todd Payne, Danbury, Conn.; Balakrishna Haridas, Cincinnati, Ohio; Nancy Theresa Thiemann, Cincinnati, Ohio; Kenneth Robert Waeber, Loveland, Ohio; Kirk David Urmey, West Milton, Ohio

[73] Assignee: Pepsico, Inc., Purchase, N.Y.

[21] Appl. No.: 08/893,457

[22] Filed: Jul. 11, 1997

[51] Int. Cl.[6] ..... B65D 1/02; B65D 1/42; B65D 23/00

[52] U.S. Cl. ..... 215/384; 215/375; 215/381; 215/382; 220/606; 220/608; 220/771

[58] Field of Search ..... 215/370, 375, 215/384, 900, 381, 382, 383; 220/771, 606

[56] References Cited

U.S. PATENT DOCUMENTS

| | | | |
|---|---|---|---|
| D. 64,152 | 3/1924 | Sweeney . | |
| D. 69,097 | 12/1925 | Schwenck . | |
| D. 72,961 | 6/1927 | Mas . | |
| D. 91,653 | 3/1934 | Guyer . | |
| D. 94,341 | 1/1935 | D'Addario . | |
| D. 112,798 | 1/1939 | Watson . | |
| D. 119,801 | 4/1940 | Dallas . | |
| D. 136,224 | 8/1943 | Hector . | |
| D. 171,605 | 3/1954 | Livingston | D58/8 |
| D. 172,010 | 4/1954 | Dillon | D58/8 |
| D. 183,040 | 6/1958 | Du Pree | D58/8 |
| 184,593 | 11/1876 | Curtice . | |
| D. 185,881 | 8/1959 | Fuerst | D58/8 |
| D. 187,302 | 2/1960 | Campbell | D58/8 |
| D. 197,355 | 1/1964 | Green | D58/25 |
| D. 198,407 | 6/1964 | Busch | D58/8 |
| D. 214,158 | 5/1969 | Pettengill | D9/100 |
| D. 221,133 | 7/1971 | Wikke | D9/45 |
| D. 238,656 | 2/1976 | Marco | D9/100 |
| D. 240,593 | 7/1976 | Koenigsberg | D9/116 |
| D. 249,329 | 9/1978 | Schacher et al. | D9/45 |
| D. 250,574 | 12/1978 | Boyle | D9/108 |
| D. 269,500 | 6/1983 | Bit | D9/350 |
| D. 272,521 | 2/1984 | Glenn | D9/370 |
| D. 277,551 | 2/1985 | Kerr | D9/367 |
| D. 278,682 | 5/1985 | Khalifa | D9/398 |
| D. 279,167 | 6/1985 | Haney et al. | D9/378 |
| D. 282,349 | 1/1986 | Larson et al. | 215/384 X |
| D. 292,378 | 10/1987 | Brandt et al. | D9/396 |
| D. 294,463 | 3/1988 | Lang | D9/392 |
| D. 300,511 | 4/1989 | Cramer | D9/396 |
| D. 308,335 | 6/1990 | Rubinoff | D9/396 |
| D. 335,455 | 5/1993 | Brown | D9/537 |
| D. 335,456 | 5/1993 | Brown | D9/537 |

(List continued on next page.)

*Primary Examiner*—Sue A. Weaver
*Attorney, Agent, or Firm*—Finnegan, Henderson, Farabow, Garrett & Dunner

[57] ABSTRACT

A thermoplastic bottle has a generally cylindrical body, in turn having an upper portion, a lower portion, and opposite sides joining at a diametric plane. A plurality of adjacent finger recesses extend about one of the opposite sides in the lower portion of the body, and a thumb depression is provided in the lower portion on the other of the opposite sides. A continuous circumferential indentation is formed in the cylindrical body between the upper portion and the lower portion to decouple pressure response of the upper and lower portions and minimize lean transfer to the upper portion resulting from expansion of the lower portion on the one of the opposite sides. The bottle is also formed with at least one vertical reinforcing indentation, preferably at least one set of three such vertical reinforcing indentations in each of the finger grooves, and at least one, preferably three spaced vertical reinforcing indentations in the thumb depression. The bottle has a bottom closure base having an odd number of at least five projecting feet, one of the feet being aligned vertically with the thumb depression so that at least three of the five feet remain in a common plane during vertical stretching to assure a stable base for maintaining the bottle in upright posture.

19 Claims, 4 Drawing Sheets

U.S. PATENT DOCUMENTS

| | | | |
|---|---|---|---|
| 1,832,806 | 11/1931 | Dawson . | |
| 1,982,282 | 11/1934 | Bock | 273/139 |
| 2,022,520 | 11/1935 | Philbrick | 215/1 |
| 2,035,404 | 3/1936 | Quinn | 215/1 |
| 2,119,546 | 6/1938 | Knaggs | 41/26 |
| 2,893,678 | 7/1959 | Homan et al. | 248/311 |
| 3,185,353 | 5/1965 | Mercier | 222/206 |
| 3,403,804 | 10/1968 | Colombo | 215/31 |
| 3,468,648 | 9/1969 | Nowak | 65/76 |
| 3,536,223 | 10/1970 | Muhlhoff et al. | 215/1 |
| 3,536,500 | 10/1970 | Cleerman et al. | 99/171 |
| 3,537,498 | 11/1970 | St. Amand | 215/384 X |
| 3,871,541 | 3/1975 | Adomaitis | 215/1 |
| 4,249,667 | 2/1981 | Pocock et al. | 215/1 C |
| 4,254,882 | 3/1981 | Yoshino | 215/1 C |
| 4,368,825 | 1/1983 | Motill | 215/1 C |
| 4,749,092 | 6/1988 | Sugiura et al. | 215/1 C |
| 4,804,097 | 2/1989 | Alberghini et al. | 215/100 A |
| 4,805,793 | 2/1989 | Brandt et al. | 215/10 |
| 4,838,464 | 6/1989 | Briggs | 222/478 |
| 4,863,046 | 9/1989 | Collette et al. | 215/381 |
| 4,865,206 | 9/1989 | Behm et al. | 215/1 C |
| 4,885,809 | 12/1989 | Muchmore | 4/259 |
| 4,890,752 | 1/1990 | Ota et al. | 215/1 C |
| 5,052,567 | 10/1991 | Colani | 215/384 |
| 5,067,622 | 11/1991 | Garver et al. | 215/1 C |
| 5,080,244 | 1/1992 | Yoshino | 215/1 C |
| 5,092,475 | 3/1992 | Krishnakumar et al. | 215/1 C |
| 5,141,120 | 8/1992 | Brown et al. | 215/384 X |
| 5,156,285 | 10/1992 | Zogg et al. | 215/100 A |
| 5,158,190 | 10/1992 | Sosenko | 215/1 R |
| 5,178,289 | 1/1993 | Krishnakumar et al. | 215/1 C |
| 5,224,614 | 7/1993 | Bono et al. | 215/384 |
| 5,261,543 | 11/1993 | Ugarelli | 215/1 C |
| 5,287,978 | 2/1994 | Young et al. | 215/1 C |
| 5,303,834 | 4/1994 | Krishnakumar et al. | 215/1 C |
| 5,320,230 | 6/1994 | Hsiung | 215/1 C |
| 5,330,054 | 7/1994 | Brown | 206/459.5 |
| 5,353,954 | 10/1994 | Steward et al. | 220/608 |
| 5,385,250 | 1/1995 | Pasquale | 220/771 X |
| 5,472,105 | 12/1995 | Krishnakumar et al. | 215/384 |
| 5,484,072 | 1/1996 | Beck et al. | 215/375 |
| 5,529,196 | 6/1996 | Lane | 215/375 |
| 5,598,941 | 2/1997 | Semersky et al. | 229/771 X |
| 5,732,838 | 3/1998 | Young | 215/384 |

PRESSURED THERMOPLASTIC BEVERAGE CONTAINING BOTTLE WITH FINGER GRIPPING FORMATIONS

BACKGROUND OF THE INVENTION

This invention relates to thermoplastic containers for pressurized liquids, and, more particularly, it concerns a plastic bottle for carbonated beverages, which is shaped to facilitate gripping by one hand.

To facilitate handling by one drinking a beverage from a bottle, it is known to provide glass bottles of generally cylindrical shape, with four peripheral finger grooves or recesses on one side of the bottle and a single thumb recess on the opposite side of the bottle. In bottles of relatively inflexible material, such as glass, the shape of the bottle has little or no effect on the ability of the bottle to stand upright, to withstand top loading forces during filling and when stacked for storage, or to withstand the pressure of the bottle contents without distortion of the bottle from its initial shape. However, when plastic materials are used in bottles for containing liquid beverages under pressure, the resiliency of the plastic container walls requires a generally symmetrical bottle configuration in order for the bottle to remain in its original configuration, both under top loading and under stress of internal pressure exerted by the bottle contents.

For example, if the known arrangement of finger grooves on one side of the glass bottle and a thumb indentation on the opposite side are incorporated in a bottle of thermoplastic material of normal material thicknesses, internal pressure tends to expand the side of the container in which the finger grooves are located, much in the manner of a bellows, so that there is a tendency for the bottle to bend on its vertical axis under the internal pressure. This bending reduces the ability of the bottle to be stacked and can reduce the ability to withstand top loading forces after being filled. The asymmetric shape also reduces the ability to withstand top loading forces prior to and during filling. In addition, asymmetric shape of a thermoplastic bottle containing fluid under pressure tends the distort the base of the bottle to a point where the bottle may not stand upright on a level surface.

With increased popularity of larger sized plastic bottles for beverages consumed during participation in sports and other recreational activities, there is a need for plastic bottles with a gripping facility resulting in bottle asymmetry giving rise to the aforementioned problems, and a solution of those problems.

SUMMARY OF THE INVENTION

The advantages and purpose of the invention will be set forth in part in the description which follows, and in part will be obvious from the description, or may be learned by practice of the invention. The advantages and purpose of the invention will be realized and attained by the elements and combinations particularly pointed out in the appended claims.

To attain the advantages and in accordance with the purpose of the invention, as embodied and broadly described herein, the invention comprises a thermoplastic bottle having a generally cylindrical body, in turn having an upper portion, a lower portion, and opposite sides joining at a diametric plane. A plurality of adjacent finger recesses extend about one of the opposite sides in the lower portion of the body, and a thumb depression is provided in the lower portion on the other of the opposite sides. A continuous circumferential indentation is formed in the cylindrical body between the upper portion and the lower portion to decouple the pressure response of the upper and lower portions and minimize lean transfer to the upper portion resulting from expansion of the lower portion on the one of the opposite sides.

In another aspect, the advantages and purpose of the invention are attained by a provision in the bottle of at least one vertical reinforcing indentation, preferably at least one set of three such vertical reinforcing indentations in each of the finger grooves, and at least one, preferably three, spaced vertical reinforcing indentations in the thumb depression.

In yet another aspect, the advantages and purpose of the invention are attained by a bottom closure base on the body of the bottle, the base having an odd number of at least five projecting feet, one of the feet being aligned vertically with the thumb depression. In this respect, the finger recesses and thumb depression located respectively on opposite sides of the lower body portion present an axially asymmetric body that responds to internal pressure by stretching in the vertical plane. By locating one of the projecting feet in alignment with the vertical plane of stretching, at least three of the five feet remain in a common plane during the stretching to assure a stable base for maintaining the bottle in upright posture.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention.

In the drawings.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

In accordance with the invention, a thermoplastic bottle is provided with a generally cylindrical body, having an upper portion, a lower portion, and opposite sides joining at a diametric plane. A plurality of adjacent finger recesses extend about one of the opposite sides in the lower portion of the body, and a thumb depression is provided in the lower portion on the other of the opposite sides. A continuous circumferential indentation is formed in the cylindrical body between the upper portion and the lower portion to decouple pressure response of the upper and lower portions and minimize lean transfer to the upper portion resulting from expansion of the lower portion on the one of the opposite sides.

Figure 1:
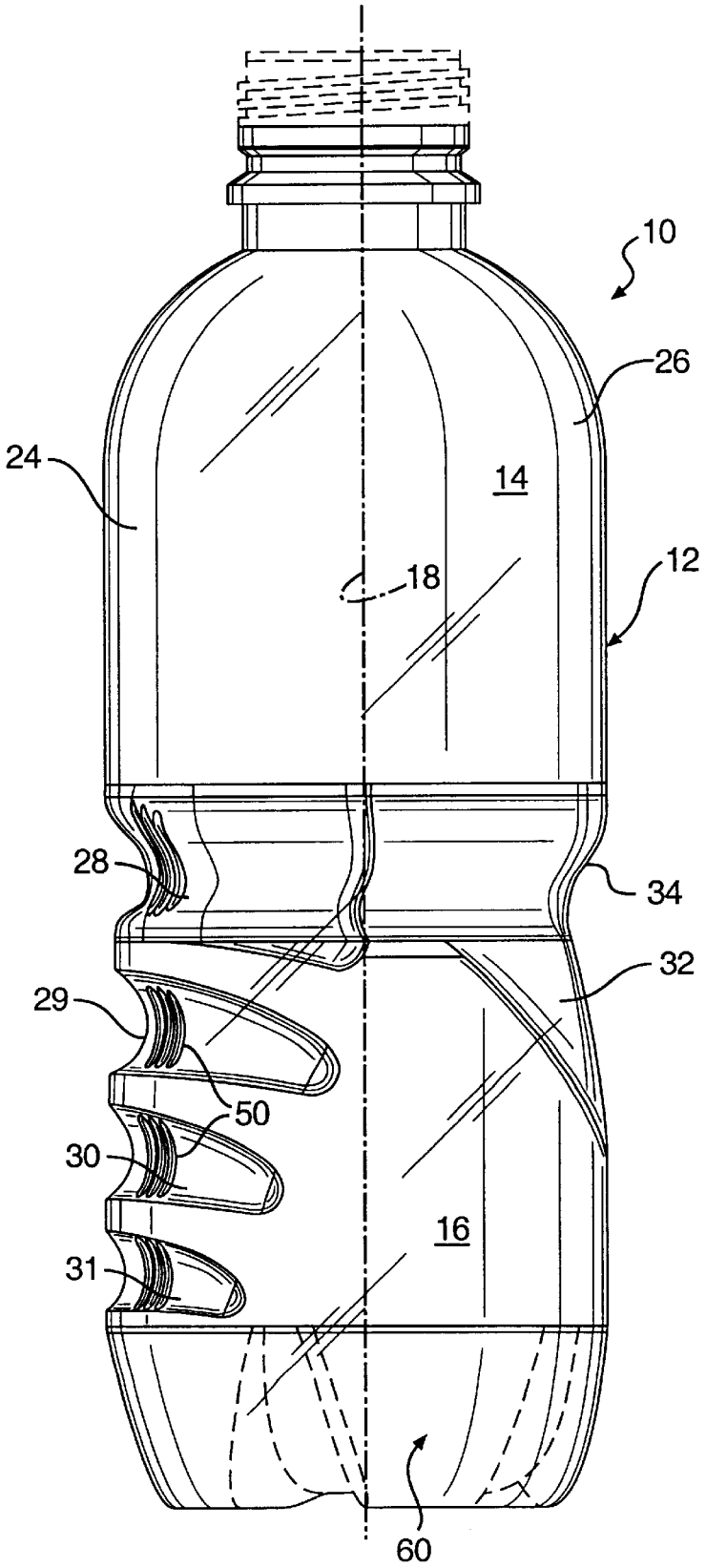
FIG. 1 is a front elevation of a plastic bottle incorporating the present invention.
Figure 2:
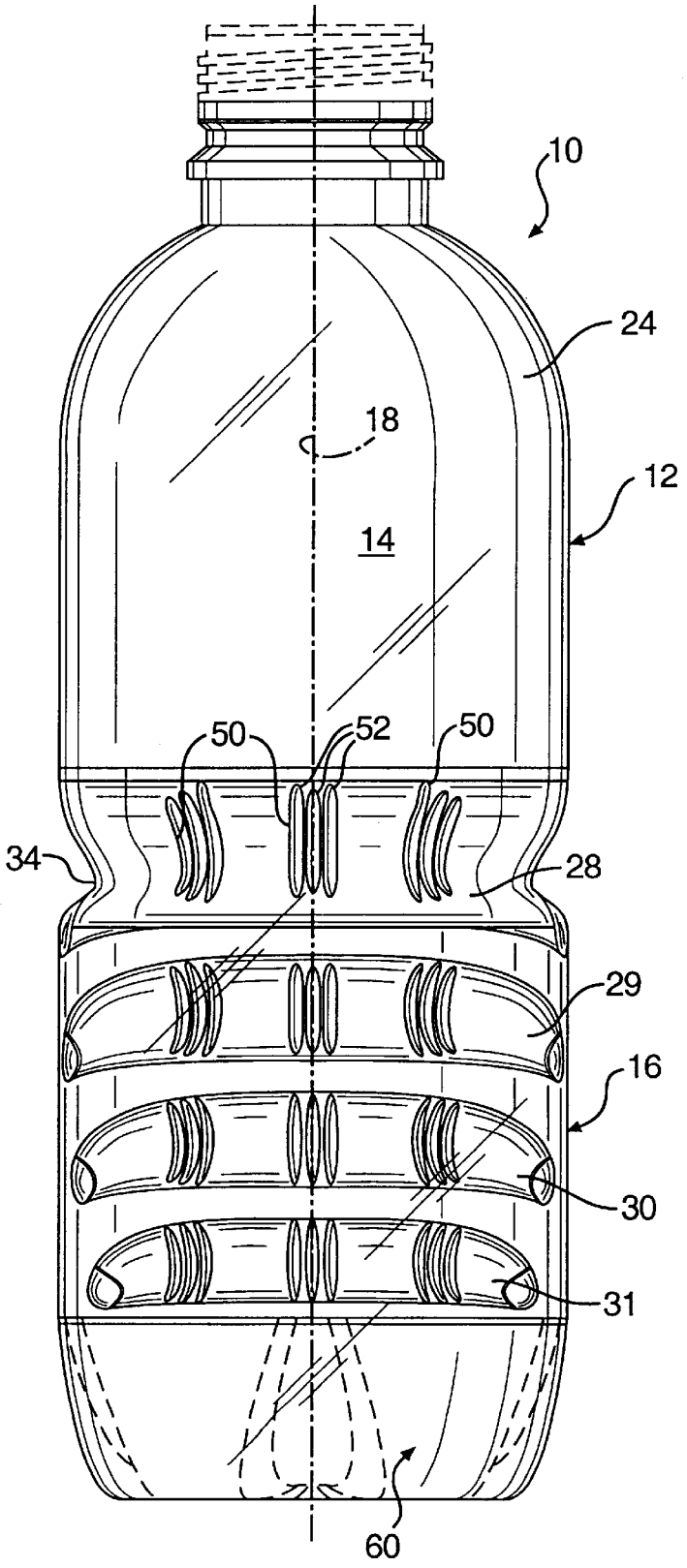
FIG. 2 is a side elevation showing one side of the bottle illustrated in FIG. 1.
Figure 3:
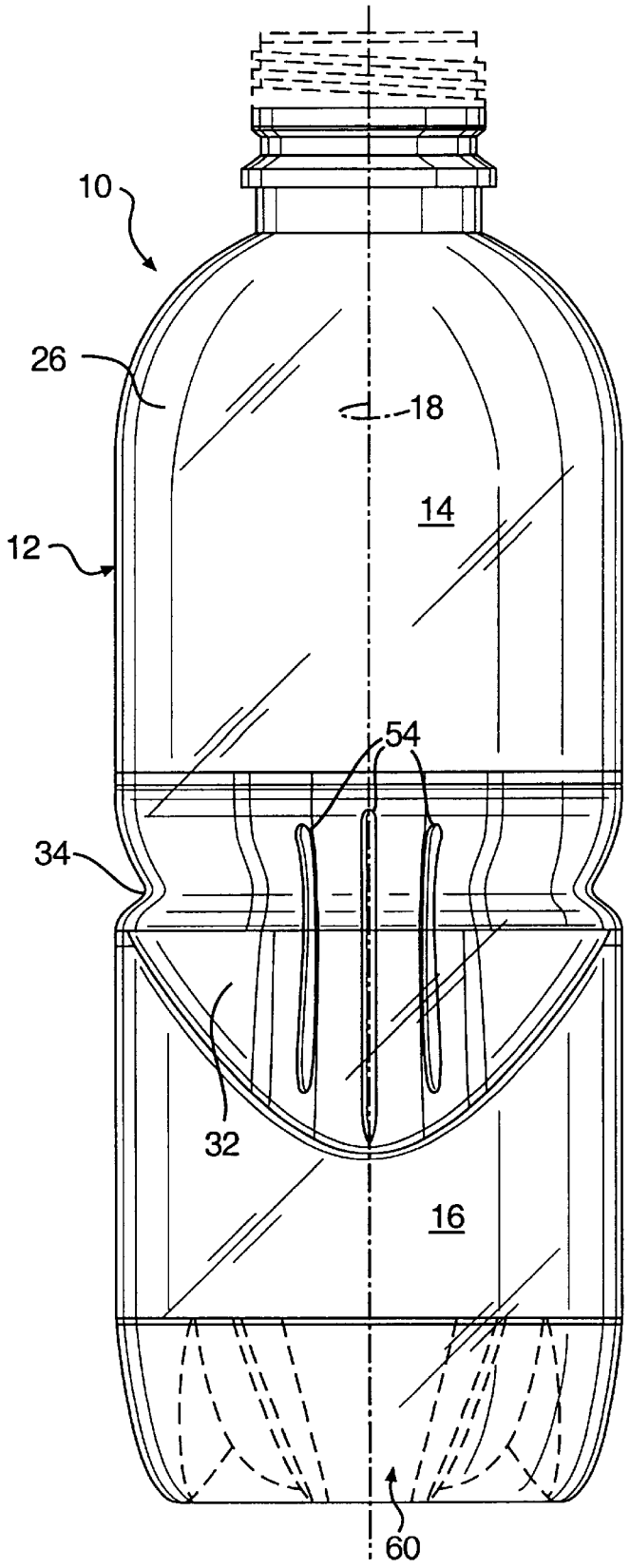
FIG. 3 is a side elevation showing the side of the bottle opposite from that shown in FIG. 2.

In the embodiment illustrated in FIGS. 1–4, a bottle, generally designated by the reference numeral 10, is shown to include a generally cylindrical body 12 having an upper portion 14 and a lower portion 16. The shape of the cylindrical body 12 may be related to a central vertical axis 18, and to two orthogonal planes 20 and 22 (FIG. 4) that intersect on the axis 18. Thus, in FIG. 1, the plane of the figure is the plane 20, whereas FIGS. 2 and 3 are drawn on the plane 22. Thus, if FIG. 1 is a front elevation, one side 24 of the bottle 10 is shown in FIG. 2, and an opposite side 26, joining with the one side 24 at the plane 22, is shown in FIG. 3.

As may be appreciated from FIGS. 1–3, the upper portion 14 of the bottle 10 is shaped as a surface of revolution about the axis 18 and is, therefore, symmetric about the axis 18. The lower portion 16, however, is asymmetric about the axis 18 and includes on the one side 24 shown in FIG. 2, four finger recesses 28, 29, 30, and 31, and, on the opposite side 26 shown in FIG. 3, a single thumb depression 32. The finger recesses 28–31 are shaped to accommodate the fingers of a left or right hand with the thumb of either hand in the thumb depression 32.

The bottle 10 is molded from thermoplastic materials conventionally used in beverage bottles, in particular, polyethylene teraphthalate (PET) in thickness ranges of from 7 mils to 15 mils, preferably, 9 mils to 14 mils. Thermoplastic materials like PET in these thicknesses are of sufficient strength to withstand both externally applied top loads, such as during filling and under stacked storage conditions, and internal loading by pressurized contents, such as carbonated beverages. However, given the asymmetric shape of the bottle 10, the adjacent finger recesses 28–31 on the one side 24 tend to act like a bellows in response to internal pressure, causing the top portion 14 to lean toward the opposite side 26. A similar tendency to lean and buckle in the opposite direction may occur as a result of excessive exterior top loading. To minimize lean transfer between the upper and lower body portions 14 and 16 of the bottle 10, an axially asymmetric circumferential indentation 34 is provided between the upper and lower body portions. The profile of the indentation 34 is shown most clearly in FIGS. 5 and 6 of the drawings.

Figure 5:
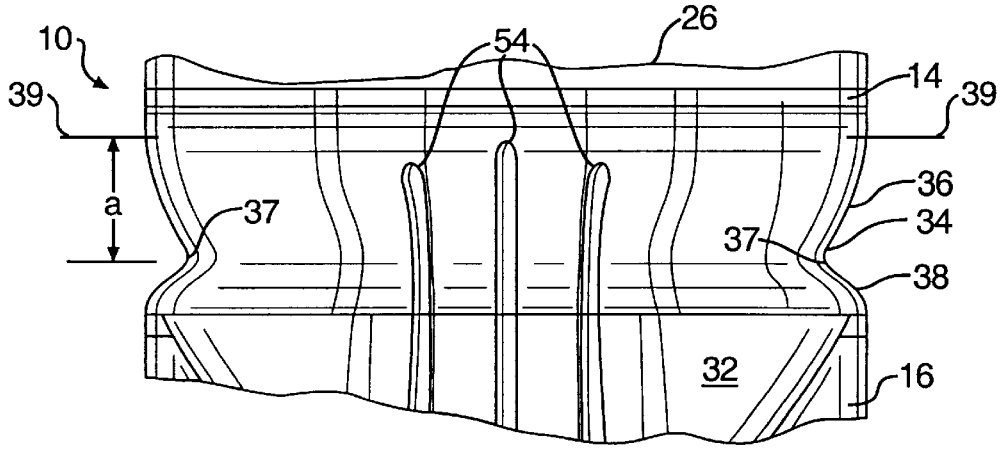
FIG. 5 is an enlarged fragmentary side elevation showing a central profile of the bottle as seen in FIG. 3.

In FIG. 5, the profile of the circumferential indentation 34 is shown at the joining plane 22 of the two sides 24 and 26 of the bottle 10. The axially asymmetric configuration of the indentation 34 is apparent from the relatively gentle inclination of an upper wall portion 36 of the indentation, joining with the upper portion 14 of the bottle, and the relatively steep inclination of a wall portion 38 of the indentation joining with the lower portion of the bottle 10. In the plane 20 of the bottle 10 that bisects the two sides 24 and 26, the profile of the circumferential indentation 34, as shown in FIG. 6, changes by merger with the top-most finger recess 28 on the one side 24, and by merger with the thumb depression 32 on the opposite side 26 of the bottle 10.

Figure 6:
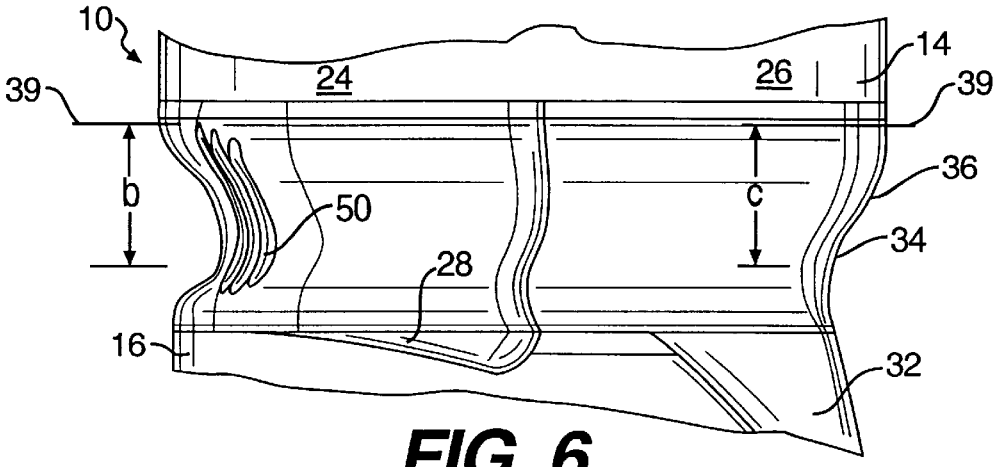
FIG. 6 is an enlarged fragmentary side elevation showing a central profile of the bottle as seen in FIG. 1.

As indicated in FIGS. 5 and 6, the transition from the relatively general inclination of the upper wall portion 36 to the relatively steep inclination of wall portion 38 occurs at the transition point 37 around the circumference of indentation 34. The transition point 37 is perferably located relative to the upper body portion 14 by the distances, a, b, and c, all measured from the location 39 where upper body portion 14 meets indention 34. As may be appreciated, distances a, b, and c are not the same around the periphery of indention 34.

As shown in FIG. 5, the first distance a from location 39 to transition point 37 is the same, or is symmetrical, on either side of thumb depression 32. Preferably, first distance a is 0.70 inches where the total height of the indentation is approximately one inch. Second distance b, the distance from location 39 to the transition point 37 in finger recess 28 is less than the third distance c measured from location 39 to the transition point 37 in the thumb depression 32. Preferably, the second distance b is 0.71 inches while the third distance c is 0.74 inches, again where the height of the indentation is about one inch.

In accordance with the present invention, at least one vertical reinforcing indentation, preferably at least one set of three such vertical reinforcing indentations, and more preferably three such sets of vertical reinforcing indentations, are provided in each of the finger recesses, and at least one, preferably three, spaced vertical reinforcing indentations are provided in the thumb depression.

In the illustrated embodiment and as shown in FIG. 2, three sets 50 of individual adjacent vertical reinforcing indentations 52 are symmetrically positioned in each of the finger recesses 28, 29, 30 and 31. As shown in FIG. 3, three similar but longer circumferentially spaced vertical indentations 54 in the thumb depression 32 extend into the circumferential indentation 34. The indentations 52 and 54 serve as stiffening ribs for the individual finger recesses 28, 29, 30 and 31 and the thumb depression 32. Also, they strengthen opposing sides of the circumferential indentation 34.

Also in accordance with the invention, the body of the bottle includes a bottom closure base having an odd number of at least five projecting feet, one of the feet being aligned vertically with the thumb depression. To gain a full understanding and an appreciation of this feature, it is noted that the finger recesses and thumb depression, located respectively on opposite sides of the lower body portion, present an asymmetric body that responds to internal pressure by stretching in the vertical plane. When such stretching occurs, the feet tend to become displaced vertically from their initial plane of support. By locating one of the projecting feet in alignment with the vertical plane of stretching, at least three of the five feet remain in the plane of support during the stretching to assure a stable base to assure that the bottle remains standing upright.

Figure 4:
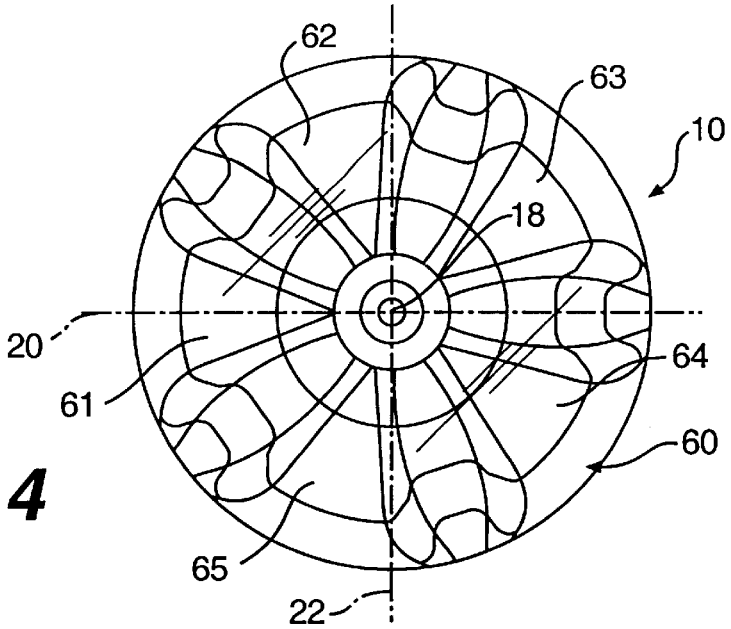
FIG. 4 is a bottom plan view showing the base of the bottle.

In the illustrated embodiment and as shown in FIG. 4, the bottle 10 is formed with a base 60 having five radially oriented, axially projecting feet 61, 62, 63, 64, and 65. The feet are angularly spaced by equal angles, in this instance, 72° angles, one of the feet, that is, the foot 61, is centered on the plane 20 that bisects the thumb depression 32 and the finger recesses 28–31.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A thermoplastic bottle comprising:

a generally cylindrical body having an upper portion, a lower portion, and opposite, asymmetric sides joining at a diametric plane;

a plurality of adjacent finger recesses extending about one of the opposite sides in the lower portion of the body;

a thumb depression in the lower portion of the other of the opposite sides; and an axially asymmetric circumferential indentation in the cylindrical body between the upper portion and the lower portion to decouple a pressure response of the upper and lower portions and minimize lean transfer to the upper portion resulting from expansion or compression of the lower portion on the one of the opposite, asymmetric sides.

2. The bottle of claim 1 further comprising at least one vertical reinforcing indentation in each of the finger recesses.

3. The bottle of claim 2 comprising at least one set of three vertical reinforcing indentations located centrally of each of the finger recesses.

4. The bottle of claim 3 comprising three sets of three vertical reinforcing indentations located symmetrically on each of the finger recesses.

5. The bottle of claim 1 comprising at least one vertical reinforcing indentation in the thumb depression.

6. The bottle of claim 5 comprising at least three spaced vertical reinforcing indentations in the thumb depression.

7. The bottle of claim 1, wherein the finger recesses are shaped to accommodate fingers of either of a left and right hand.

8. The bottle of claim 1, wherein the thumb depression is shaped to accommodate either of a left and right hand thumb.

9. The bottle of any one of claims 1–8, formed of polyethylene teraphthalate (PET).

10. The bottle of claim 9, wherein the PET is of a thickness in the range of from 7 mils to 15 mils.

11. The bottle of claim 9, wherein the PET is of a thickness in the range of from 9 mils to 14 mils.

12. The bottle of claim 1 comprising a bottom closure base on the body, the base having an odd number of at least five projecting feet, one of the feet being aligned vertically with the thumb depression.

13. A bottle of thermoplastic material, comprising:

an asymmetric body means responsive to internal pressure by stretching in a vertical plane; and a bottom closure base means on the body means, the base means having an odd number of at least five projecting feet, one of the feet being aligned with the vertical plane of stretching so that at least three of the at least five feet remain in a plane of support during stretching in the vertical plane.

14. The bottle of claim 13, wherein the asymmetric body means comprises a plurality of adjacent finger recesses extending about one side of the body means centered on the vertical plane of stretching and a single thumb depression opposite from the one side.

15. The bottle of claim 13, further comprising:

an axially asymmetric circumferential indentation in the asymmetric body means above the bottom closure base means to compensate for asymmetric stretching in the vertical plane.

16. A thermoplastic bottle comprising:

a generally cylindrical body having an upper portion, a lower portion, and opposite sides joining at a diametric plane;

a plurality of adjacent finger recesses extending about one of the opposite sides in the lower portion of the body;

a thumb depression in the lower portion of the other of the opposite sides;

a circumferential indentation in the cylindrical body between the upper portion and the lower portion to decouple a pressure response of the upper and lower portions and minimize lean transfer to the upper portion resulting from expansion of the lower portion on the one of the opposite sides; and three sets of three vertical reinforcing indentations located on each of the finger recesses.

17. The thermoplastic bottle of claim 16, further comprising:

at least three spaced vertical reinforcing indentations in the thumb depression.

18. A thermoplastic bottle comprising:

a generally cylindrical body having an upper portion, a lower portion, and opposite sides joining at a diametric plane;

a plurality of adjacent finger recesses extending about one of the opposite sides in the lower portion of the body;

a thumb depression in the lower portion of the other of the opposite sides;

a circumferential indentation in the cylindrical body between the upper portion and the lower portion to decouple a pressure response of the upper and lower portions and minimize lean transfer to the upper portion resulting from expansion of the lower portion on the one of the opposite sides; and at least three spaced vertical reinforcing indentations in the thumb depression.

19. The thermoplastic bottle of claim 18, further comprising:

three sets of three vertical reinforcing indentations located symmetrically on each of the finger recesses.

* * * * *